US010403467B2

(12) United States Patent
Higashi

(10) Patent No.: US 10,403,467 B2
(45) Date of Patent: Sep. 3, 2019

(54) MAGNETRON

(71) Applicant: Toshiba Hokuto Electronics Corporation, Asahikawa-shi, Hokkaido (JP)

(72) Inventor: Masatoshi Higashi, Hokkaido (JP)

(73) Assignee: Toshiba Hokuto Electronics Corporation, Asahikawa-shi, Hokkaido (JP)

( * ) Notice: Subject to any disclaimer, the term of this patent is extended or adjusted under 35 U.S.C. 154(b) by 0 days.

(21) Appl. No.: 16/085,029

(22) PCT Filed: Dec. 27, 2016

(86) PCT No.: PCT/JP2016/088826
§ 371 (c)(1),
(2) Date: Sep. 14, 2018

(87) PCT Pub. No.: WO2017/163524
PCT Pub. Date: Sep. 28, 2017

(65) Prior Publication Data

US 2019/0080872 A1 Mar. 14, 2019

(30) Foreign Application Priority Data

Mar. 25, 2016 (JP) ..... 2016-062477

(51) Int. Cl.
*H05B 6/76* (2006.01)
*H01J 23/15* (2006.01)
(Continued)

(52) U.S. Cl.
CPC ..... *H01J 23/54* (2013.01); *H01J 23/15* (2013.01); *H01J 25/50* (2013.01); *H05B 6/76* (2013.01)

(58) Field of Classification Search
None
See application file for complete search history.

(56) References Cited

U.S. PATENT DOCUMENTS 3,584,177 A * 6/1971 Bucksbaum ..... H05B 6/763 219/741
3,718,867 A * 2/1973 Tenenholtz ..... H03C 5/04 331/87
4,163,175 A * 7/1979 Tashiro ..... H01J 23/15 315/39.51
4,194,142 A * 3/1980 Gerard ..... H01J 23/20 315/39.51
4,254,318 A * 3/1981 Ohkawa ..... H04L 7/02 174/366
(Continued)

FOREIGN PATENT DOCUMENTS

JP S62-122028 A 6/1987

OTHER PUBLICATIONS

Mar. 21, 2017—International Search Report—Intl App PCT/JP2016/088826.

*Primary Examiner* — Dion Ferguson
*Assistant Examiner* — Srinivas Sathiraju
(74) *Attorney, Agent, or Firm* — Banner & Witcoff, Ltd.

(57) ABSTRACT

To provide a magnetron capable of effectively suppressing a plurality of higher harmonic wave components with a simple configuration.

A magnetron 1 is designed so that: a choke part 60 consisting of a first choke 30 and a second choke 32 being a plurality of chokes provided on the inside of a metal sealing body 7 on an output unit 5 are provided to suppress higher harmonic waves; and a plurality of choke grooves 31A, 31B and 31C that correspond to each of higher harmonic wave components larger than the number of the first choke 30 and second choke 32 and different in each frequency are formed by the choke part 60 and the metal sealing body 7.

3 Claims, 6 Drawing Sheets

(51) Int. Cl.
*H01J 23/54* (2006.01)
*H01J 25/50* (2006.01)

(56) References Cited

U.S. PATENT DOCUMENTS

| | | | | | |
|---|---|---|---|---|---|
| 4,459,563 | A * | 7/1984 | Kawaguchi | H01J 23/54 | 315/39.53 |
| 4,531,104 | A * | 7/1985 | Schaeffer | H01J 25/55 | 315/39.55 |
| 4,705,989 | A * | 11/1987 | Takada | H01J 23/15 | 313/341 |
| 6,437,511 | B1 * | 8/2002 | Choi | H01J 23/54 | 315/39.51 |
| 2015/0083714 | A1 * | 3/2015 | Turetken | H05B 6/763 | 219/740 |
| 2015/0170866 | A1 * | 6/2015 | Yang | H01J 23/10 | 219/761 |
| 2015/0380198 | A1 * | 12/2015 | Park | H01J 9/18 | 315/39.51 |
| 2016/0172145 | A1 * | 6/2016 | Higashi | H01J 23/213 | 315/39.51 |
| 2019/0080872 | A1 * | 3/2019 | Higashi | H01J 23/54 | |
| 2019/0085428 | A1 * | 3/2019 | Pettman | C22B 3/44 | |

* cited by examiner

MAGNETRON

CROSS REFERENCE TO RELATED APPLICATIONS

This is a U.S. National Phase Application under 35 U.S.C. § 371 of International Application No. PCT/JP2016/088826, filed Dec. 27, 2016, which claims priority to Japanese Application 2016-062477, filed Mar. 25, 2016, and which was published Under PCT Article 21(2), the entire contents of which are incorporated herein by reference.

TECHNICAL FIELD

The present invention relates to a magnetron, and is suitably applicable to a continuous wave (CW) magnetron used for microwave heating equipment such as an electronic microwave oven.

BACKGROUND ART

In general, magnetrons for electronic microwave ovens generate microwaves at 2450 MHz band. In this case, a high frequency component having an integer time of the frequency of a fundamental wave component is generated with the fundamental wave component. When the high frequency component is radiated from an output unit of a magnetron, it is propagated to a heating space in the magnetron with the fundamental wave component. Because high frequency components have shorter wavelengths and are difficult to be shielded, they are sometimes leaked to the outside and occur radio interference or the like; the limit value of leakage is set by law. Therefore, conventional magnetrons are designed so that a choke groove is formed in an output unit to suppress arbitrary high frequency components by the choke groove (see for example Patent Document 1).

As such magnetrons, as an output unit 205 of a magnetron 201 shown in FIG. 8, there is a magnetron provided with a second harmonic choke groove 84, a fourth harmonic choke groove 86 and a fifth harmonic choke groove 88. In the magnetron 201, three quarter-wave type chokes corresponding to three higher harmonic waves including an exhaust pipe 21 are arranged, and suppressing a second harmonic wave (4.9 GHz) by the second harmonic choke groove 84, a fourth harmonic wave (9.8 GHz) by the fourth harmonic choke groove 86, and a fifth harmonic wave (12.25 GHz) by the fifth harmonic choke groove 88 formed by a metal sealing body 207 and a fifth harmonic choke 90. The fifth harmonic choke 90 is prepared separately from the metal sealing body 207, and is joined to the metal sealing body by a brazing material (that is, brazed).

On the other hand, as an output unit 305 of a magnetron 301 shown in FIG. 9, there is a magnetron in that the fifth harmonic choke 90 and a metal sealing body 307 of the output unit 305 are integrated to reduce the number of parts.

PRIOR ART DOCUMENTS

Patent Documents

[Patent Document 1]
Japanese Patent Application Laid-open Publication No. 2005-50572

SUMMARY OF THE INVENTION

Problems to be Solved by the Invention

If trying to suppress an arbitrary higher harmonic wave by a choke, a choke having a length slightly shorter than its quarter wavelength becomes necessary. And, if suppressing many more higher harmonic waves, it is necessary to dispose chokes as many as the number. On the other hand, there has been a problem that miniaturization of magnetrons has been demanded for a long time and disposing many chokes has become difficult. Therefore, to effectively suppress higher harmonic wave components generated from a magnetron with a simple configuration has been demanded.

The present invention has done considering the above problem, and aiming to provide a magnetron capable of effectively suppressing a plurality of higher harmonic wave components with a simple configuration.

Means for Solving the Problems

In order to solve the above problem, in a magnetron of the present invention, it is provided with a choke part formed by a plurality of chokes provided inside a metal sealing body on an output unit to suppress higher harmonic waves, and a plurality of choke grooves which correspond to each of higher harmonic wave components larger than the number of chokes and different in each frequency are formed by the choke part and metal sealing body.

The present invention is able to form choke grooves larger than the number of chokes, and thus, a plurality of higher harmonic wave components can be effectively suppressed with a simple configuration.

Advantageous Effect of the Invention

According to the present invention, a magnetron capable of effectively suppressing a plurality of high frequency components with a simple configuration can be accomplished.

EMBODIMENTS FOR CARRYING OUT THE INVENTION

With reference to the accompanying drawings, embodiments for carrying out the invention (hereinafter, it is referred to as embodiments) will be described.

1. First Embodiment

[1-1. Configuration of Magnetron]

Figure 1:
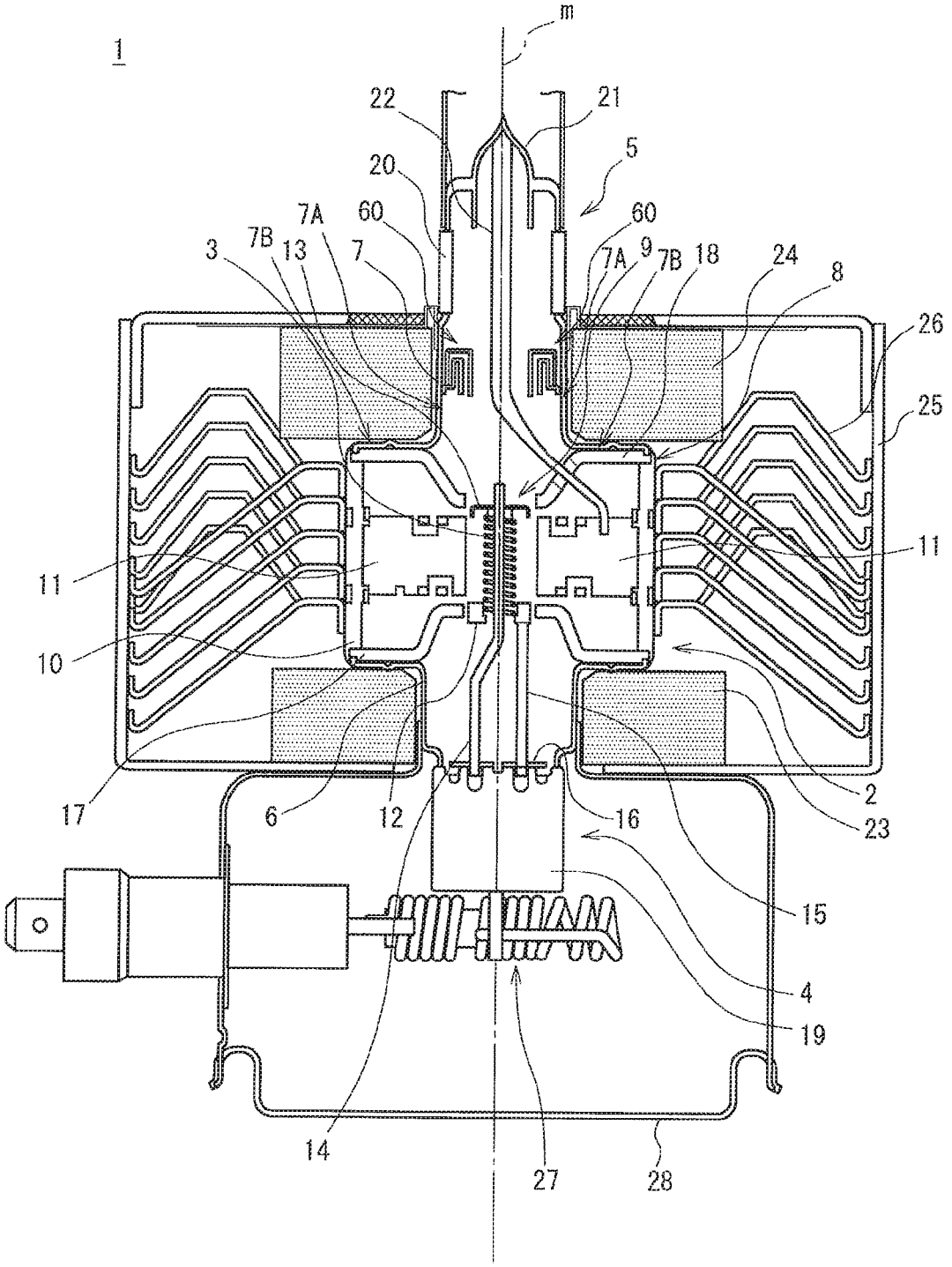
FIG. 1 is a longitudinal sectional view showing the overall structure of a magnetron of a first embodiment.

A magnetron 1 shown in FIG. 1 is a magnetron for an electronic microwave oven that generates microwaves at 2450 MHz band. The magnetron 1 has an oscillating unit 2 that generates microwaves at 2450 MHz band, an input unit 4 for supplying electric power to a cathode 3 positioned at the center of the oscillating unit 2, and an output unit 5 for taking microwaves oscillated from the oscillating unit 2 out of the tube (magnetron 1). The oscillating unit 2, input unit 4, and output unit 5 are provided along a tube axis m being the central axis of the magnetron 1. That is, the input unit 4 is provided on one end side of the oscillating unit 2 in the tube axis direction (the lower side in FIG. 1), and the output unit 5 is provided on the other end side (the upper side in FIG. 1). The input unit 4 and output unit 5 are joined to the oscillating unit 2 via a metal sealing body 6 on the input side and a metal sealing body 7 on the output side respectively in a vacuum airtight state.

The oscillating unit 2 has an anode part 8 and a cathode part 9. The anode part 8 has an anode cylinder 10 and a plurality of (e.g., ten) vanes 11. The anode cylinder 10 is cylindrically formed, and is disposed so that its central axis passes through the tube axis m being the central axis of the magnetron 1.

Each of the vanes 11 is formed into a sheet, and they are disposed inside the anode cylinder 10 centering around the tube axis m. The outside end part of each vane 11 is joined to the inner peripheral surface of the anode cylinder 10, and the inside end part is a free end. A cylindrical space enclosed with the free ends of the plural vanes 11 is an electron operating space.

The cathode part 9 has the cathode 3, two end hats 12, 13, and two support rods 14, 15. The cathode 3 is a spiral cathode, and is provided on the tube axis m in the electron operating space. The end hats 12, 13 are fixed to the input side end part (lower end part) of the cathode 3 and the output side end part (upper end part) of that respectively to prevent electrons from emitting. The cathode 3 is further connected to the support rods 14, 15 via the end hats 12, 13 respectively. Two support rods 14, 15 are led out of the tube via an intermediate plate 16.

In the oscillating unit 2, a pair of pole pieces 17, 18 are provided facing each other inside the input side end part (lower end part) of the anode cylinder 10 and the output side end part (upper end part) of that respectively, as interposing a space between the end hats 12 and 13. The input side pole piece 17 in which a through hole is provided at its center part is formed in a funnel shape wider toward the input side (downward) centering the through hole, and also the output side pole piece 18 in which a through hole is provided at its center part is formed in a funnel shape wider toward the output side (upward). The pole pieces 17, 18 are disposed so that the tube axis m passes through those center of the through hole respectively.

Furthermore, to the outer peripheral part of the input side pole piece 17, the upper end part of the almost-cylindrical metal sealing body 6 extending in the direction of the tube axis m is adhered. The metal sealing body 6 is fixed to the lower end part of the anode cylinder 10 in a vacuum airtight state. On the other hand, to the outer peripheral part of the output side pole piece 18, the lower end part of the almost-cylindrical metal sealing body 7 extending in the direction of the tube axis m is adhered. The metal sealing body 7 is fixed to the upper end part of the anode cylinder 10 in a vacuum airtight state.

To the lower end part of the input side metal sealing body 6, a ceramic stem 19 constituting the input unit 4 is joined in a vacuum airtight state. That is, the support rods 14, 15 held by the ceramic stem 19 are connected to the cathode 3 by passing through the inside of the metal sealing body 6.

On the other hand, to the upper end part of the output side metal sealing body 7, a ceramic insulation tube 20 constituting the output unit 5 is joined in an airtight manner. To the upper end of the insulation tube 20, an exhaust tube 21 is joined in an airtight manner. Furthermore, an antenna 22 which is led from one of the plural vanes 11 penetrates the output side pole piece 18, passes through the inside of the metal sealing body 7, and extending to its upper end side. The tip of the antenna 22 is pinched with the exhaust tube 21 and fixed in an airtight state.

The output side metal sealing body 7 is a cylindrical body, and is formed by a cylindrical part 7A extending in the direction of the tube axis m, and a ringed part 7B spread outward from the lower end of the cylindrical part 7A. Furthermore, the insulating cylinder 20 is joined to the upper end part of the cylindrical part 7A of the metal sealing body 7, and the exhaust tube 21 is joined to the upper end part of the insulating cylinder 20. Furthermore, a choke part 60 being a cylindrical body and separated part from the metal sealing body 7 is joined to the inside of the cylindrical part 7A of the metal sealing body 7.

On the outside of the metal sealing bodies 6 and 7, a pair of ring-shaped magnets 23, 24 are provided facing each other as interposing the anode cylinder 10 in the direction of the tube axis m. The anode cylinder 10 and magnets 23, 24 are covered with a yoke 25: a firm magnetic circuit is formed by the pair of magnets 23, 24 and yoke 25.

Furthermore, a radiator 26 is provided between the anode cylinder 10 and the yoke 25. Radiant heat from the cathode 3 and heat loss of the oscillating unit 2 is transferred to the radiator 26 via the anode cylinder 10, and is released to the outside of the magnetron 1. The cathode 3 is connected to a filter circuit 27 having a coil and a lead-through capacitor via the support rods 14, 15. The filter circuit 27 is contained in a filter box 28.

[1-2. Configuration of Choke Part]

Figure 2:
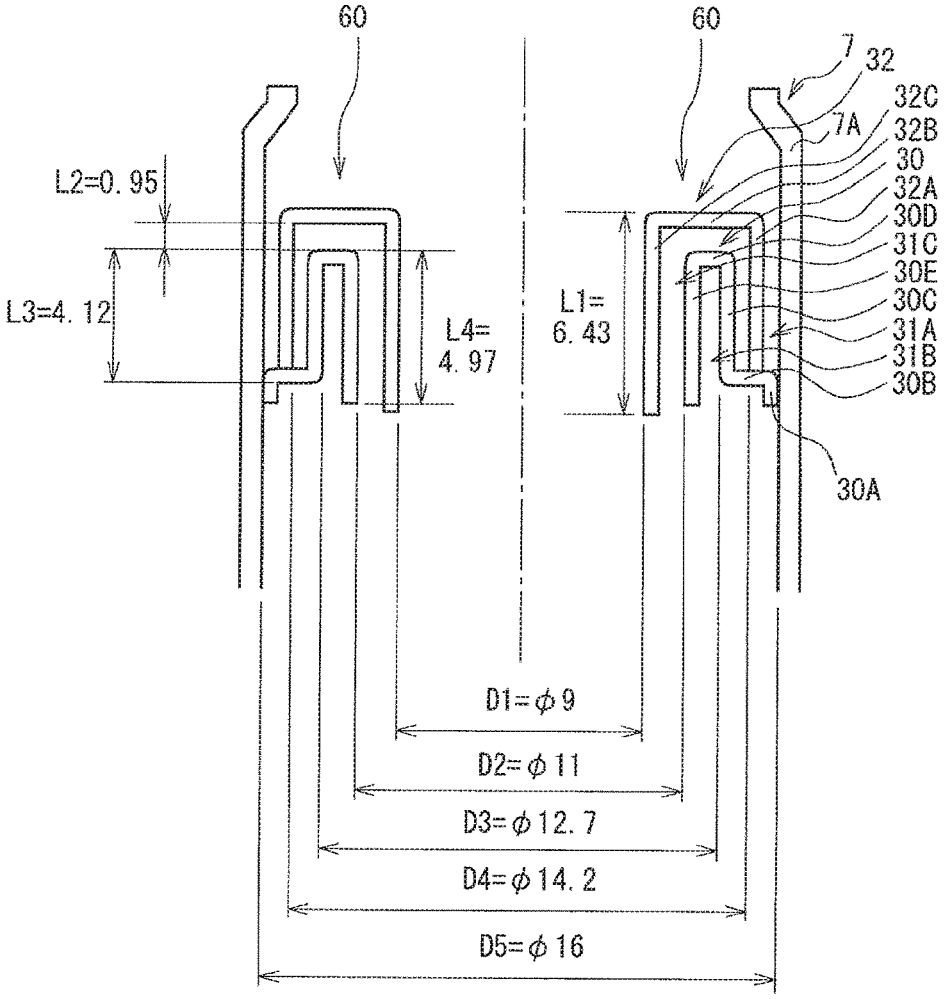
FIG. 2 is a sectional view showing the configuration of a choke of the first embodiment.

As shown in FIG. 2, a choke part 60 is formed by a first choke 30 and a second choke 32, and they are concentrically arranged centering the tube axis m.

The first choke 30 is formed by: an outermost peripheral part 30A which is provided so that its central axis passes through the tube axis m, extends in the direction of the tube axis m and contacting with the inner surface of the cylindrical part 7A; a first annular part 30B extending inward from the upper end of the outermost peripheral part 30A perpendicularly to the direction of the tube axis m; a first cylindrical part 30C extending upward from the inner end of the first annular part 30B in parallel to the direction of the tube axis m; a second annular part 30D extending inward from the upper end of the first cylindrical part 30C perpendicularly to the direction of the tube axis m; and a second cylindrical part 30E extending downward from the inner end of the second annular part 30D in parallel to the direction of the tube axis m.

The first annular part 30B and second annular part 30D are mutually in parallel, and also the first cylindrical part 30C and second cylindrical part 30E are mutually in parallel. The respective lengths of the first annular part 30B and second annular part 30D in a diameter direction perpendicularly to the direction of the tube axis m are selected to prescribed lengths, and also those of the first cylindrical part 30C and second cylindrical part 30E in the direction of the tube axis m are selected to prescribed lengths.

The second choke 32 is formed by: a first cylindrical part 32A which is provided so that its central axis passes through the tube axis m, of which the lower end is joined to the first annular part 30B, and which extends upward at the almost center of the second choke 32 between the first cylindrical part 30C and the cylindrical part 7A in parallel to the direction of the tube axis m; a first annular part 32B which is annular and extends from the upper end of the first cylindrical part 32A to the inner side than the second cylindrical part 30E perpendicularly to the direction of the tube axis m; and a second cylindrical part 32C which extends downward from the inner end of the first annular part 32B to the almost same vertical position as the lower end of the second cylindrical part 30E in parallel to the direction of the tube axis m.

The first cylindrical part 32A and second cylindrical part 32C are mutually in parallel; the first annular part 30B, second annular part 30D and first annular part 32B are mutually in parallel; and also the first cylindrical part 30C, second cylindrical part 30E, first cylindrical part 32A and second cylindrical part 32C are mutually in parallel. The length of the first annular part 32B in the diameter direction is selected to a prescribed length; and also the respective lengths of the first cylindrical part 32A and second cylindrical part 32C in the direction of the tube axis m are selected to prescribed lengths.

Three choke grooves 31A, 31B and 31C are formed inside the metal sealing body 7 by the metal sealing body 7, first choke 30 and second choke 32. Among of these, the outside choke groove 31A is formed by the inner surface of the cylindrical part 7A of the metal sealing body 7, the first annular part 30B and the first cylindrical part 32A. The choke groove 31B which is inner than the choke groove 31A is formed by the first cylindrical part 30C, second annular part 30D and second cylindrical part 30E. The innermost choke groove 31C is formed by the first annular part 30B, first cylindrical part 30C, second annular part 30D, second cylindrical part 30E, first cylindrical part 32A, first annular part 32B and second cylindrical part 32C; is between the first choke 30 and the second choke 32; and of which the section is U-shaped as interposing the choke groove 31B, so that a higher harmonic wave having a long wavelength can be suppressed with a compact size.

These three choke grooves 31A, 31B and 31C are different in their lengths in the direction of the tube axis m (namely depth). That is, these choke grooves 31A, 31B and 31C are called ¼ wavelength type, and are formed so that their lengths (depths) in the direction of the tube axis m become ¼ of the wavelength of an arbitrary higher harmonic component aimed to suppress respectively. Thereby, the magnetron 1 can suppress three higher harmonic components of different frequencies by these three choke grooves 31A, 31B and 31C.

Specifically, in the magnetron 1, lengths are respectively set as follows: the inside diameter D1 of the second cylindrical part of the second choke being the inside diameter of the second cylindrical part 32C is set to 9 mm; the inside diameter D2 of the second cylindrical part of the first choke being the inside diameter of the second cylindrical part 30E is set to 11 mm; the inside diameter D3 of the first cylindrical part of the first choke being the inside diameter of the first cylindrical part 30C is set to 12.7 mm; the inside diameter D4 of the first cylindrical part of the second choke being the inside diameter of the first cylindrical part 32A is set to 14.2 mm; the inside diameter D5 of the cylindrical part being the inside diameter of the cylindrical part 7A is set to 16 mm; the length L1 of the second cylindrical part of the second choke being the length of the second cylindrical part 32C in the direction of the tube axis is set to 6.43 mm; the distance L2 between the annular parts being the distance between the first annular part 32B and the first annular part 30B in the direction of the tube axis is set to 0.95 mm; the length L3 of the first cylindrical part of the first choke being the length of the first cylindrical part 30C in the direction of the tube axis is set to 4.12 mm; and the length L4 of the second cylindrical part of the first choke being the length of the second cylindrical part 30E in the direction of the tube axis is set to 4.97 mm.

Figure 4:
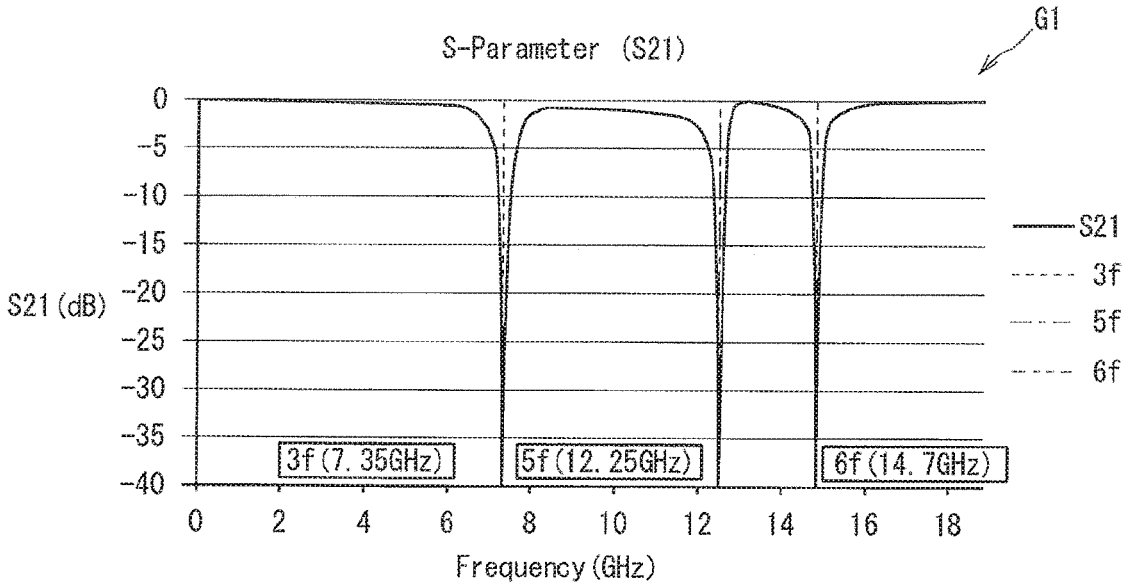
FIG. 4 is a graph showing a S parameter of the first embodiment.

In the magnetron 1 of the first embodiment, when the outside diameter of an antenna is 2.5 mm and the plate thickness of the first choke 30 and second choke 32 is 0.3 mm, by setting the respective diameters and the dimensions in the axis direction as shown in FIG. 2, the choke grooves act respectively as follows: the choke groove 31B acts as a choke for a sixth higher harmonic wave (14.7 GHz); the choke groove 31A acts as a choke for a fifth higher harmonic wave (12.25 GHz); and the choke groove 31C acts as a choke for a third higher harmonic wave (7.35 GHz). Here, as shown in FIG. 4 of a graph G1 of a S parameter in the magnetron 1 that was obtained by analysis with a simple model, it is found that the choke grooves 31A, 31B, 31C have attenuation peaks near the corresponding higher harmonic waves respectively.

[1-3. Manufacturing Process of Output Unit]

Figure 3:
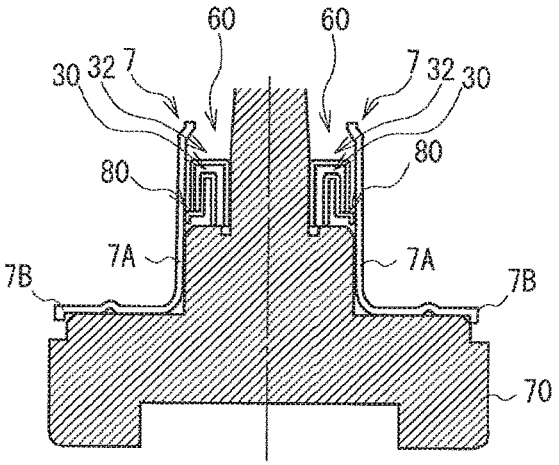
FIG. 3 is a sectional view showing the manufacturing process of an output unit.

Here, a manufacturing process of the output unit 5 will be described with reference to FIG. 3. The metal sealing body 7 and first choke 30 of the output unit 5 are press-formed from cold-rolling steel sheets. Specifically, the metal sealing body 7 is formed by press formation from a cold-rolling sheet with a thickness of e.g. 0.5 mm, and the first choke 30 is with a thickness of e.g. 0.3 mm.

First, the first choke 30, Ag—Cu brazing material 80, second choke 32 and metal sealing body 7 are placed on a jig 70 in this order. The height of the first choke 30 is specified by the jig 70, and its position in the diameter direction is specified by the inner surface of the cylindrical part 7A of the metal sealing body 7. Note that, so that the outermost peripheral part 30A of the first choke 30 adheres to the inner surface of the cylindrical part 7A of the metal sealing body 7, the outside diameter of the first choke 30 is formed so as to be slightly smaller than for example the inside diameter of the cylindrical part 7A. The Ag—Cu brazing material 80 is ring-shaped (annular) for example, and is placed on the outer peripheral part of the first choke 30 (that is, the position where the outermost peripheral part 30A of the first choke 30 (FIG. 2) contacts the inner surface of the cylindrical part 7A). The second choke 32 is placed on the first annular part 32B of the first choke 30 (FIG. 2). The position of the second choke 32 in the diameter direction is specified by the jig 70. These are inputted in a furnace in this state, heated, and cooled, so that they are joined respectively. Note that, a heating temperature in the brazing process should be set to a temperature where Ag—Cu brazing materials melt (e.g. higher than 780 degrees C.).

At this time, the contact part of the outermost peripheral part 30A of the first choke 30 and the inner surface of the cylindrical part 7A, and the contact part of the first cylindrical part 32A of the second choke 32 and the first annular part 30B of the first choke 30 are adjacent, so that a brazing material melted by a high temperature flows into the contact part of the first choke 30 and the cylindrical part 7A, and the contact part of the second choke 32 and the first choke 30.

As a result, the first choke 30 and second choke 32 can be brazed to the cylindrical part 7A at once.

[1-4. Effects etc.]

According to the above structure, in the magnetron 1, the choke part 60 is formed by the mutually separated two chokes, the first choke 30 and second choke 32. In addition to this, in the magnetron 1, the choke groove 31A is formed by the second choke 32 and metal sealing body 7, the choke groove 31B is formed by the first choke 30 itself, and the choke groove 31C is formed by the first choke 30 and second choke 32, that is, three choke grooves are formed. Therefore, in the magnetron 1, the choke grooves larger than the number of the chokes can be formed. It enables to effectively suppress a plurality of higher harmonic waves different in each frequency. Thereby, in the magnetron 1, the choke grooves capable of suppressing many higher harmonic waves can be disposed in a limited space in the metal sealing body 7, and thus miniaturization can be accomplished.

Furthermore, an annular brazing material is placed on the outer peripheral part of the first choke 30 and is melted, and is flown into the contact part of the first choke 30 and the cylindrical part 7A, and that of the second choke 32 and the first choke 30. As a result, the first choke 30 and second choke 32 are brazed to the cylindrical part 7A at once. Therefore, in the magnetron 1, it is unnecessary to prepare a brazing material for brazing the second choke 32 to the cylindrical part 7A separately from the first choke 30. It enables to reduce costs for brazing materials generally high for that. In addition to this, in the magnetron 1, the first choke 30 and second choke 32 can be brazed to the cylindrical part 7A at once: therefore, manufacturability can be improved.

According to the above structure, the magnetron 1 is designed so that: the choke part 60 consisting of the first choke 30 and the second choke 32 being a plurality of chokes provided on the inside of the metal sealing body 7 on the output unit 5 are provided to suppress higher harmonic waves; and a plurality of choke grooves 31A, 31B and 31C that correspond to each of higher harmonic wave components different in each frequency larger than the number of the first choke 30 and second choke 32 are formed by the choke part 60 and the metal sealing body 7. Thereby, in the magnetron 1, the choke grooves larger than the number of the chokes can be formed. It enables to effectively suppress a plurality of higher harmonic waves with a simple configuration.

2. Second Embodiment

[2-1. Configuration of Magnetron]

Figure 5:
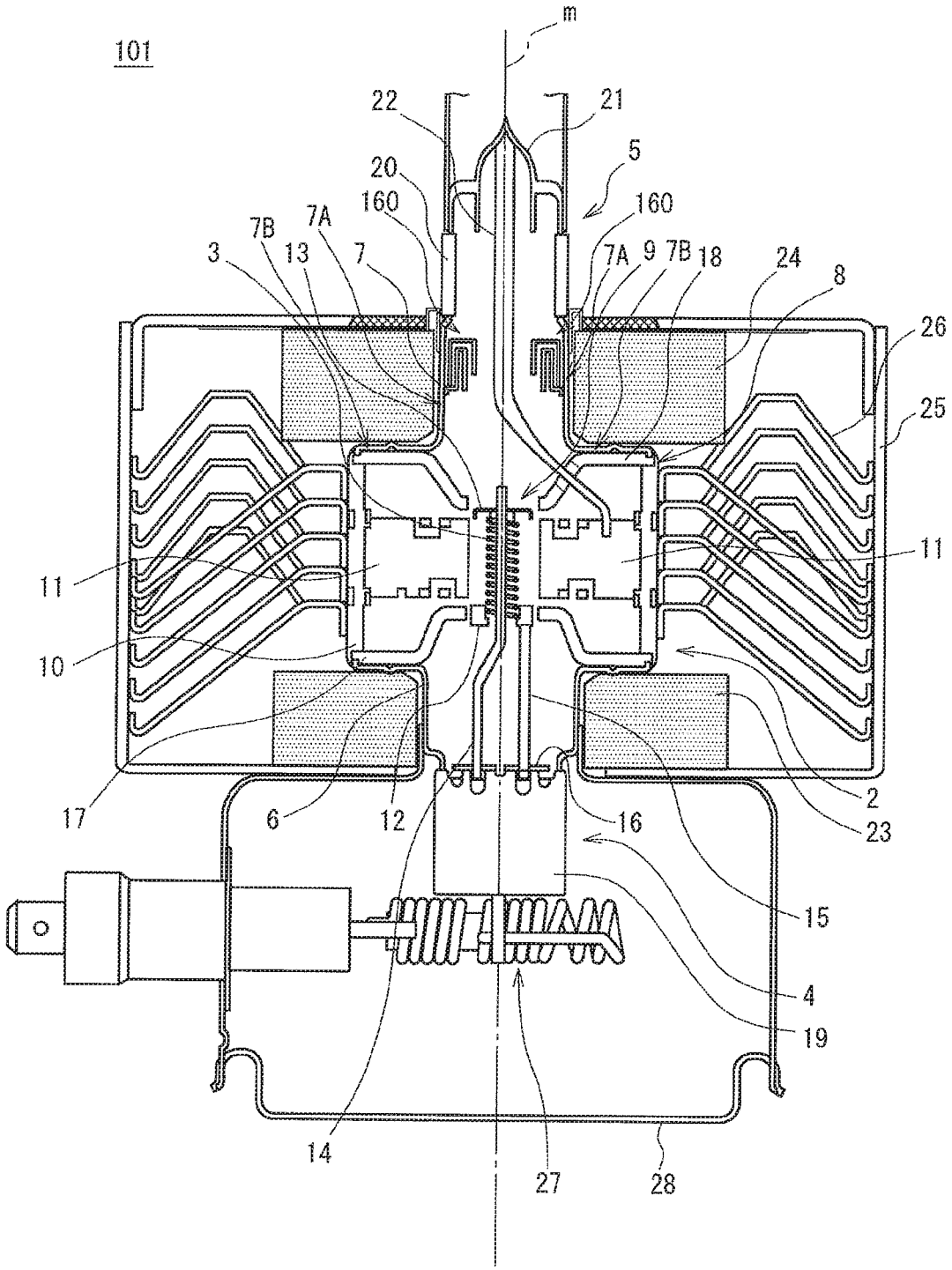
FIG. 5 is a longitudinal sectional view showing the overall structure of a magnetron of a second embodiment.

As shown in FIG. 5 in which the same reference symbols are added to the corresponding parts in FIG. 1, a magnetron 101 of a second embodiment is similarly formed other than that a choke part 160 is provided instead of the choke part 60 in comparison to the magnetron 1 of the first embodiment.

[2-2. Configuration of Choke Part]

Figure 6:
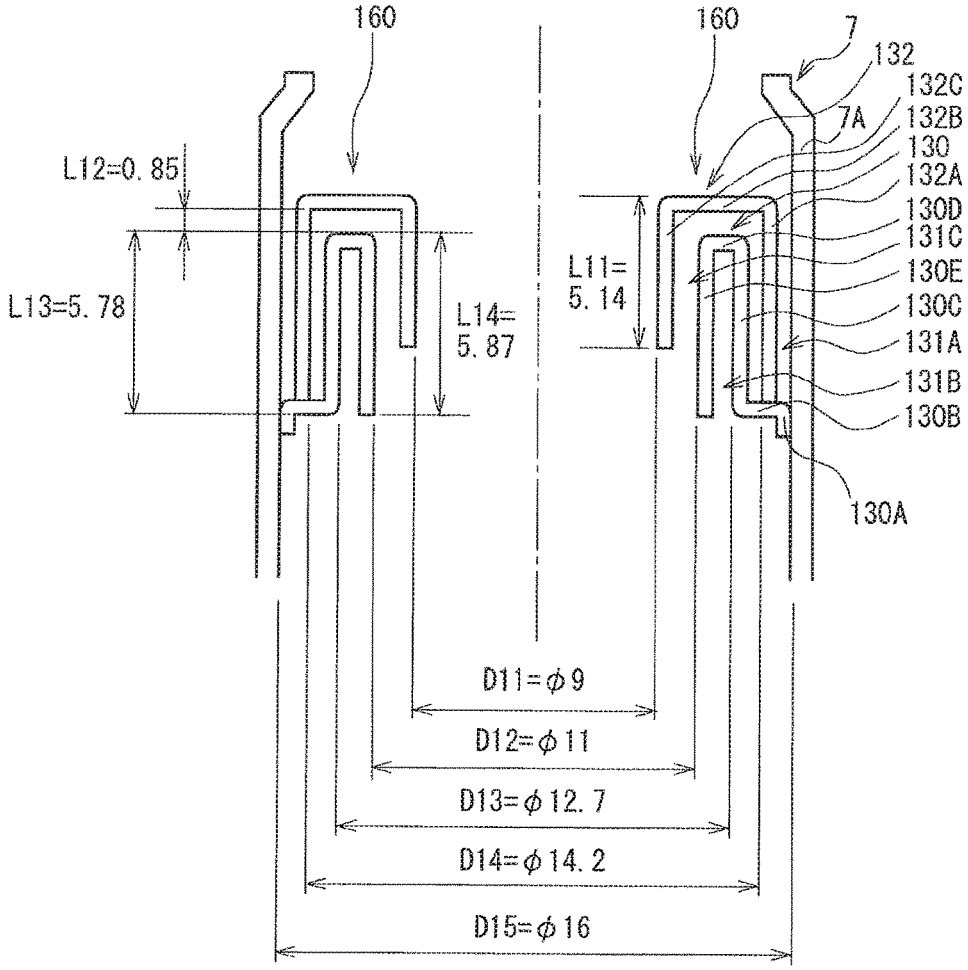
FIG. 6 is a sectional view showing the configuration of a choke of the second embodiment.

As shown in FIG. 6 in which the same reference symbols are added to the corresponding parts in FIG. 2, the choke part 160 is formed by a first choke 130 and a second choke 132, and are concentrically disposed centering around the tube axis m.

The first choke 130 is formed by: an outermost peripheral part 130A that is provided so that its central axis passes through the tube axis m, extends in the direction of the tube axis m, and contacting with the inner surface of a cylindrical part 7A; a first annular part 130B being annular and extending inward from the upper end of the outermost peripheral part 130A perpendicularly to the direction of the tube axis m; a first cylindrical part 130C being cylindrical and extending upward from the inside end of the first annular part 130B in parallel to the direction of the tube axis m; a second annular part 130D extending inward from the upper end of the first cylindrical part 130C perpendicularly to the direction of the tube axis m; and a second cylindrical part 130E being cylindrical and extending downward from the inside end of the second annular part 130D in parallel to the direction of the tube axis m. The first annular part 130B and second annular part 130D are mutually in parallel, and also the first cylindrical part 130C and second cylindrical part 130E are mutually in parallel.

The second choke 132 is formed by: a first cylindrical part 132A that is provided so that its central axis passes through the tube axis m, the lower end is joined to the first annular part 130B, and extends upward at the almost center of the second choke 132 between the first cylindrical part 130C and the cylindrical part 7A in parallel to the direction of the tube axis m; a first annular part 132B being annular and extending from the upper end of the first cylindrical part 132A to the inner side than the second cylindrical part 130E perpendicularly to the direction of the tube axis m; and a second cylindrical part 132C being cylindrical and extending downward from the inside end of the first annular part 132B to the upper side than the lower end of the second cylindrical part 130E in parallel to the direction of the tube axis m. The first cylindrical part 132A and second cylindrical part 132C are mutually in parallel, the first annular part 130B, second annular part 130D and first annular part 132B are mutually in parallel, and also the first cylindrical part 130C, second cylindrical part 130E, the first cylindrical part 132A and second cylindrical part 132C are mutually in parallel.

Three choke grooves 131A, 131B, 131C which respectively correspond to the choke grooves 31A, 31B, 31C of the first embodiment are formed inside the metal sealing body 7 by the metal sealing body 7, first choke 130 and second choke 132.

These three choke grooves 131A, 131B, 131C are different in each length in the direction of the tube axis m (namely depth). These choke grooves 131A, 131B, 131C are formed so that their lengths (depths) in the direction of the tube axis m become a quarter wavelength of an arbitrary higher harmonic wave component aimed to suppress respectively. Thereby, in the magnetron 101 three higher harmonic components different in each frequency can be suppressed by these choke grooves 131A, 131B, 131C.

Specifically, in the magnetron 101, lengths are respectively set as follows: the inside diameter D11 of the second cylindrical part of the second choke being the inside diameter of the second cylindrical part 132C is set to 9 mm; the inside diameter D12 of the second cylindrical part of the first choke being the inside diameter of the second cylindrical part 130E is set to 11 mm; the inside diameter D13 of the first cylindrical part of the first choke being the inside diameter of the first cylindrical part 130C is set to 12.7 mm; the inside diameter D14 of the first cylindrical part of the second choke being the inside diameter of the first cylindrical part 132A is set to 14.2 mm; the inside diameter D15 of the cylindrical part being the inside diameter of the cylindrical part 7A is set to 16 mm; the length L11 of the second cylindrical part of the second choke being the length of the second cylindrical part 32C in the direction of the tube axis is set to 5.87 mm; the distance L12 between the annular parts being the distance between the first annular part 132B and the first annular part 130B in the direction of the tube axis is set to 0.85 mm; the length L13 of the first cylindrical part of the first choke being the length of the first cylindrical part 130C in the direction of the tube axis is set to 5.14 mm; and the length L14 of the second cylindrical part of the first choke being the length of the second cylindrical part 130E in the direction of the tube axis is set to 5.78 mm.

Figure 7:
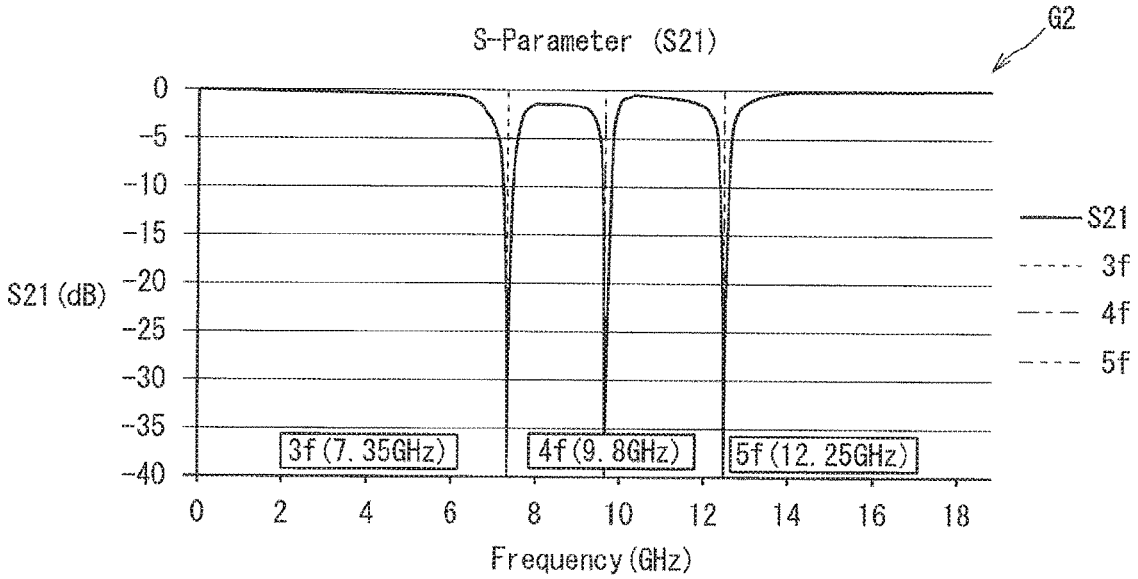
FIG. 7 is a graph showing a S parameter of the second embodiment.
Figure 8:
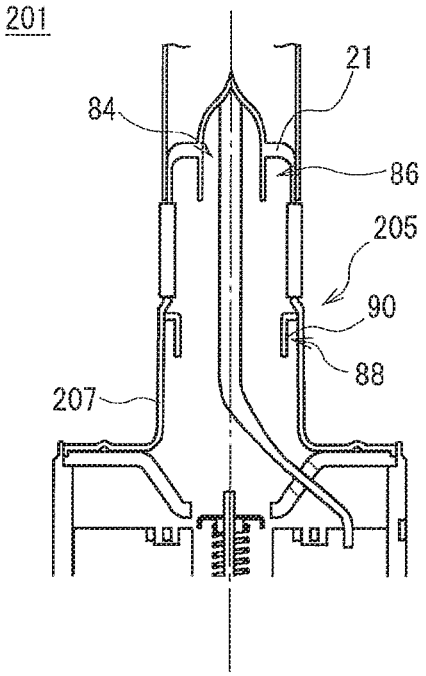
FIG. 8 is a sectional view showing the configuration of an output unit of a conventional magnetron.
Figure 9:
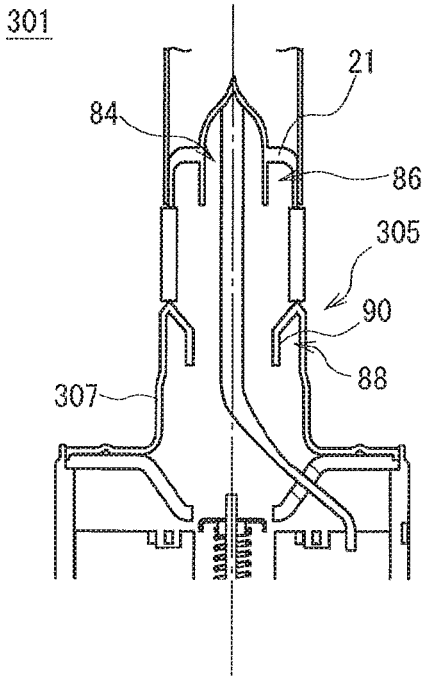
FIG. 9 is a sectional view showing the configuration of another output unit of a conventional magnetron.

In the magnetron 101 of the second embodiment, when the outside diameter of an antenna is 2.5 mm similarly to the magnetron 1 of the first embodiment and the plate thickness of the first choke 130 and second choke 132 is 0.3 mm, by setting the respective diameters and the dimensions in the axis direction as shown in FIG. 6, the choke grooves act respectively as follows: the choke groove 131B acts as a choke for a fifth higher harmonic wave (12.25 GHz); the choke groove 131A acts as a choke for a fourth higher harmonic wave (9.8 GHz); and the choke groove 131C acts as a choke for a third higher harmonic wave (7.35 GHz). Here, as shown in FIG. 7 of a graph G2 of an S parameter in the magnetron 101 that was obtained by analysis with a simple model, it is found that the choke grooves 131A, 131B, 131C have attenuation peaks near the corresponding higher harmonic waves respectively.

3. Other Embodiments

In the above-mentioned embodiments, it has dealt with the case where the three choke grooves 31A, 31B, 31C are formed by the cylindrical part 7 and the two chokes, the first choke 30 and second choke 32. The present invention is not only limited to this, but also, for instance, by changing the number and the dimensions of cylindrical parts and annular parts forming choke, four or more choke grooves may be formed by two chokes: two or more choke grooves larger than the number of chokes may be formed by an arbitrary number of chokes. Specifically, for instance, a cylindrical part may be formed by lengthening inward the lower end part of the second cylindrical part 32C in the second choke 32 in the diameter direction and bending the top upward, and a choke groove may be formed between the second cylindrical part 32C and the cylindrical part: four choke grooves may be formed in two chokes. It is also similar in the second embodiment.

Furthermore, in the above-mentioned first embodiment, it has dealt with the case where the section of the choke groove 31C is U-shape. The present invention is not only limited to this, but also the section of the choke groove 31C may be a linear shape along the tube axis direction. It is also similar in the second embodiment.

Furthermore, in the above-mentioned first embodiment, it has dealt with the case where an annular brazing material is placed on the outer peripheral part of the first choke 30, and is melted and flown into the contact part of the first choke 30 and the cylindrical part 7A, and that of the second choke 32 and the first choke 30, so that the first choke 30 and second choke 32 are brazed to the cylindrical part 7A at once. The present invention is not only limited to this, but also by bending outward the lower end part of the first cylindrical part 32A in the second choke 32 of in the diameter direction and joining the end part to the inside surface of the cylindrical part 7A, the second choke 32 and first choke 30 may be brazed to the cylindrical part 7A separately. It is also similar in the second embodiment.

Furthermore, in the above-mentioned first embodiment, it has dealt with the case where the choke groove 31A is upward and the choke grooves 31B, 31C are downward. The present invention is not only limited to this, but also for instance, by providing the first choke 30 and second choke 32 reversely upside down, the choke grooves 31A, 31B, 31C may be provided in the direction opposite to the magnetron 1 respectively. Furthermore, in the above-mentioned first embodiment, it has dealt with the case where the outermost peripheral part 30A of the first choke 30 has the shape extending downward from the outside end of the first annular part 30B. However, the present invention is not only limited to this, but also it may have a shape extending upward from the outside end of the first annular part 30B. It is also similar in the second embodiment.

Furthermore, in the above-mentioned first embodiment, it has dealt with the case where the metal sealing body 7, first choke 30 and second choke 32 are press-formed from cold-rolling steel sheets. The present invention is not only limited to this, but also the metal sealing body 7, first choke 30 and second choke 32 may be formed from metallic materials made of other materials. It is also similar in the second embodiment.

Furthermore, in the above-mentioned first embodiment, it has explained joining of the metal sealing body 7 of the magnetron 1 and the second choke 32 of the first choke 30. However, other parts than the metal sealing body 7, first choke 30 and second choke 32 may have a configuration different from the configuration of the above-mentioned magnetron 1. It is also similar in the second embodiment.

Furthermore, as to the above-mentioned combination of the parts dimensions of the metal sealing body 7, first choke 30 and second choke 32, and the parts dimensions of the first choke 130 and second choke 132, other various combinations of dimensions are applicable.

Furthermore, in the above-mentioned first embodiment, it has dealt with the case where the cylindrical parts forming the first choke 30 and second choke 32 extend mutually in parallel in the tube axis direction, and the annular parts extend perpendicularly to the tube axis direction. The present invention is not only limited to this, but also the cylindrical parts forming the first choke 30 and second choke 32 may not extend mutually in parallel in the tube axis direction, and the annular parts may not extend perpendicularly to the tube axis direction. It is also similar in the second embodiment.

Furthermore, in the above-mentioned first embodiment, it has dealt with the case where the magnetron 1 or 101 as a magnetron 1 is formed by the choke part 60 or 160 as a choke part. The present invention is not only limited to this, but also a magnetron may be formed by a choke part having various configurations other than that.

EXPLANATION OF REFERENCE SYMBOLS

1, 101, 201, 301: magnetron
2: oscillating unit
3: cathode
4: input unit
5, 205, 305: output unit
6: metal sealing body
7, 207, 307: metal sealing body
7A: cylindrical part
7B: ringed part
8: anode part
9: cathode part
10: anode cylinder
11: vane
12, 13: end hat
14, 15: support rod
16: intermediate plate

17: pole piece
18: pole piece
19: ceramic stem
20: insulating cylinder
21: exhaust tube
22: antenna
23, 24: magnet
25: yoke
26: radiator
27: filter circuit
28: filter box
30, 130: first choke
30A, 130A: outermost peripheral part
30B, 130B: first annular part
30C, 130C: first cylindrical part
30D, 130D: second annular part
30E, 130E: second cylindrical part
31A, 31B, 31C, 131A, 131B, 131C: choke groove
32, 132: second choke
32A, 132A: first cylindrical part
32B, 132B: first annular part
32C, 132C: second cylindrical part
60, 160: choke part
70: jig
80: brazing material
84: second harmonic choke groove
86: fourth harmonic choke groove
88: fifth harmonic choke groove
90: fifth harmonic choke
m: tube axis
D1, D11: inside diameter of second cylindrical part of second choke
D2, D12: inside diameter of second cylindrical part of first choke
D3, D13: inside diameter of first cylindrical part of first choke
D4, D14: inside diameter of first cylindrical part of second choke
D5, D15: inside diameter of cylindrical part
L1, L11: length of second cylindrical part of second choke
L2, L12: distance between annular parts
L3, L13: length of first cylindrical part of first choke
L4, L14: length of second cylindrical part of first choke

The invention claimed is:

1. A magnetron, having:

a choke part formed by a first choke and a second choke provided inside a metal sealing body on an output unit; wherein:

the first choke is formed by:

an outermost peripheral part of the first choke that is provided so that its central axis passes through a tube axis, extends in the tube axis direction and contacting with an inner surface of the metal sealing body;

a first annular part of the first choke extending from an upper end of the outermost peripheral part of the first choke to the tube axis side;

a first cylindrical part of the first choke extending upward in the tube axis direction from an inner end of the first annular part of the first choke;

a second annular part of the first choke extending from an upper end of the first cylindrical part of the first choke to the tube axis side; and a second cylindrical part of the first choke being cylindrical and extending downward in the tube axis direction from an inner end of the second annular part of the first choke, and the second choke is formed by:

a first cylindrical part of the second choke being cylindrical, that is provided so that its central axis passes through the tube axis, its lower end is joined to the first annular part of the first choke, and extends upward in the tube axis direction between the first cylindrical part of the first choke and the metal sealing body;

a first annular part of the second choke being annular and extending from an upper end of the first cylindrical part of the second choke to side than and inward of the second cylindrical part of the first choke to the tube axis side; and a second cylindrical part of the second choke being cylindrical and extending downward in the tube axis direction from an inner end of the first annular part of the second choke;

wherein a plurality of tube grooves which correspond to each of at least three high frequency components different in each frequency are formed by the first choke, the second choke and the metal sealing body.

2. The magnetron according to claim 1, wherein;

the first choke and the second choke are joined to the metal sealing body by one brazing material.

3. The magnetron according to claim 2, wherein;

the first choke and the second choke are brazed to the metal sealing body by one brazing material by one-time brazing process.

* * * * *